US012543868B2

(12) United States Patent
Eckelkamp et al.

(10) Patent No.: US 12,543,868 B2
(45) Date of Patent: Feb. 10, 2026

(54) MOUNTING PANEL SYSTEM

(71) Applicant: AOB Products Company, Columbia, MO (US)

(72) Inventors: Brett Eckelkamp, Fulton, MO (US); Michael Cottrell, Ashland, MO (US); Kyle Martin, Columbia, MO (US); Ryan Donahue, Columbia, MO (US)

(73) Assignee: AOB Products Company, Columbia, MO (US)

( * ) Notice: Subject to any disclaimer, the term of this patent is extended or adjusted under 35 U.S.C. 154(b) by 98 days.

(21) Appl. No.: 18/482,846

(22) Filed: Oct. 6, 2023

(65) Prior Publication Data

US 2024/0115062 A1 Apr. 11, 2024

Related U.S. Application Data

(60) Provisional application No. 63/413,752, filed on Oct. 6, 2022.

(51) Int. Cl.
*A47F 5/08* (2006.01)

(52) U.S. Cl.
CPC ..... *A47F 5/0815* (2013.01)

(58) Field of Classification Search
CPC ..... A47F 5/0815
USPC ..... 248/220.31
See application file for complete search history.

(56) References Cited

U.S. PATENT DOCUMENTS 2,859,008 A 11/1958 Zimmer
2,961,724 A 11/1960 Alling
3,037,732 A 6/1962 Roman
3,069,122 A 12/1962 Babajoff
3,193,225 A 7/1965 Terlinde
3,195,846 A 7/1965 Dahlhauser
3,227,412 A 1/1966 Terlinde
3,255,987 A * 6/1966 Gatch ..... F16B 21/02 248/314
3,310,271 A * 3/1967 King ..... A47F 5/0815 248/222.52
4,405,110 A 9/1983 Gibbons
4,434,960 A * 3/1984 Berry ..... A47F 5/0815 248/223.31
4,619,428 A 10/1986 Bailey
5,144,709 A * 9/1992 Rooney ..... H01L 21/4842 257/730
5,165,640 A 11/1992 Williams
(Continued)

OTHER PUBLICATIONS

Guardian Security Structures, Weapons Storage Systems 50"H x 23"W-Package, Published at least as early as Sep. 2, 2022, https://gssdoors.com/gun-storage.html#!/50-H-X-23-W-PACKAGE/p/313538041/category=0, downloaded Sep. 2, 2022, 3 pages.
(Continued)

*Primary Examiner* — Anita M King
(74) *Attorney, Agent, or Firm* — Stinson LLP

(57) ABSTRACT

A panel mounting system and associated components and methods. The panel mounting system includes a panel system comprising a plurality of panels. The panel mounting system also includes a plurality of panel accessories selectively mountable on the panel system at desired locations. The panel accessories can include a panel mount and an object support. The panel mounting system provides several advantages compared to conventional peg board mounting systems.

30 Claims, 15 Drawing Sheets

(56) References Cited

U.S. PATENT DOCUMENTS

| | | | | |
|---|---|---|---|---|
| 5,807,047 | A | 9/1998 | Cox | |
| 6,266,250 | B1 | 7/2001 | Foye | |
| 6,364,141 | B1 | 4/2002 | Ehrgott | |
| 6,364,260 | B1 * | 4/2002 | Lorincz | A47B 96/06 211/113 |
| 6,675,980 | B2 | 1/2004 | Ehrgott | |
| 6,719,481 | B2 | 4/2004 | Hoffmann | |
| 6,929,227 | B2 | 8/2005 | Hofmann et al. | |
| 7,228,977 | B2 * | 6/2007 | Perkins | A47B 95/008 211/94.01 |
| D573,828 | S | 7/2008 | Clokey et al. | |
| D582,189 | S | 12/2008 | Peterson | |
| 7,490,724 | B2 | 2/2009 | Weck et al. | |
| 7,677,400 | B2 | 3/2010 | Bayazit et al. | |
| D636,621 | S | 4/2011 | Kluge et al. | |
| 8,177,311 | B2 * | 5/2012 | Apgood, II | A47B 57/34 312/245 |
| D669,291 | S | 10/2012 | Johnson et al. | |
| D678,701 | S | 3/2013 | Hansen | |
| 8,522,986 | B2 | 9/2013 | Kitchen | |
| 8,534,469 | B2 | 9/2013 | Northrup, Jr. et al. | |
| 8,596,595 | B2 | 12/2013 | Devito | |
| D700,454 | S | 3/2014 | Callif et al. | |
| 8,678,206 | B2 | 3/2014 | Kubiniec | |
| 8,842,012 | B2 | 9/2014 | Sankey | |
| 8,899,424 | B2 | 12/2014 | Bayazit et al. | |
| D722,462 | S | 2/2015 | Callahan | |
| 9,027,270 | B2 | 5/2015 | Berenson et al. | |
| D731,866 | S | 6/2015 | Paulick | |
| D742,726 | S | 11/2015 | Glass et al. | |
| D745,378 | S | 12/2015 | Kusmirek | |
| 9,305,444 | B2 | 4/2016 | Sankey | |
| D763,018 | S | 8/2016 | Walter | |
| D767,378 | S | 9/2016 | Sehl | |
| D767,978 | S | 10/2016 | Kusmirek | |
| D771,409 | S | 11/2016 | Wall | |
| 9,486,913 | B2 | 11/2016 | Thieman | |
| D793,120 | S | 8/2017 | Bullard | |
| D799,239 | S | 10/2017 | Wall | |
| D800,477 | S | 10/2017 | Wall | |
| 9,792,791 | B2 | 10/2017 | Sankey | |
| 10,051,978 | B2 | 8/2018 | Gupta et al. | |
| 10,226,138 | B2 | 3/2019 | Tear | |
| 10,285,515 | B1 | 5/2019 | Desilets | |
| 10,405,675 | B1 | 9/2019 | Yu | |
| D867,017 | S | 11/2019 | Altizer | |
| 10,490,038 | B2 | 11/2019 | Sankey | |
| 10,827,853 | B2 | 11/2020 | Ma et al. | |
| 11,566,868 | B2 | 1/2023 | Mack | |
| 2005/0218280 | A1 | 10/2005 | Rojas | |
| 2009/0014401 | A1 * | 1/2009 | Tallman | A47F 5/0846 211/106.01 |
| 2019/0045946 | A1 | 2/2019 | Gupta et al. | |
| 2020/0082685 | A1 | 3/2020 | Sankey | |
| 2020/0187676 | A1 | 6/2020 | Wengerd et al. | |
| 2020/0378712 | A1 | 12/2020 | Kuniniec | |

OTHER PUBLICATIONS

Gallow Technologies, Handgun Barrel Hanger #HGBH-1L and Related Products, Published at least as early as Sep. 2, 2022, https://www.gallowtech.com/handgun-barrel-hanger.aspx, downloaded Sep. 2, 2022, 7 pages.

OmniWall, Corner Panel, Published at least as early as Sep. 2, 2022, https://omniwallusa.com/omniwall-corner-panel/, downloaded Sep. 2, 2022, 7 pages.

GunSafes.com, Securelt Tactical Wall Panels, Published at least as early as Sep. 2, 2022, https://www.gunsafes.com/tactical-walls-modwall-panel-single.html, downloaded Sep. 2, 2022, 4 pages.

* cited by examiner

MOUNTING PANEL SYSTEM

CROSS-REFERENCE TO RELATED APPLICATION

The present application claims priority to U.S. Provisional Application No. 63/413,752, filed Oct. 6, 2022, which is hereby incorporated by reference in its entirety.

FIELD

The present disclosure generally relates to storage and/or display systems and components thereof.

BACKGROUND

Conventional peg boards are used to mount various peg board accessories for holding tools, etc. Such conventional peg board accessories usually mount no the peg boards in a non-stable manner, permitting the peg board accessories to rattle thereon and/or the peg board accessory to move when an object is removed therefrom.

SUMMARY

In one aspect, a panel accessory is for mounting on a panel having at least first and second mounting openings. The panel accessory comprises a panel mount including an object support connector, a first panel connector, and a second panel connector. The first panel connector extends rearward with respect to the object support connector for receipt in the first mounting opening of the panel. The second panel connector extends rearward with respect to the object support connector for receipt in the second mounting opening of the panel to mount the panel mount on the panel. The second panel connector comprises a first cam surface configured to cam against an edge of the second mounting opening to resiliently deform the second panel connector to permit passage of the second panel connector in the second mounting opening for mounting the panel mount on the panel. The panel accessory comprises an object support connected to the object support connector. The panel mount configured to support the object support when the panel mount is mounted on the panel.

In another aspect, a panel accessory mount is configured to mount to a panel having a front surface, a rear surface, and at least one mounting opening. The panel accessory mount comprises a main body and at least one brace extending rearward of the main body. The at least one brace includes a rear surface configured to engage a front surface of the panel when the accessory mount is mounted on the panel. The panel accessory mount comprises a first panel connector comprising a hook configured to engage the rear surface of the panel when the accessory mount is mounted on the panel. The panel accessory mount comprises a second panel connector comprising an arm. The arm is resiliently deflectable with respect to the hook to permit mounting of the panel mount on the panel.

In another aspect, a panel for mounting panel accessories thereon comprises a web including a plurality of mounting openings for receiving the panel accessories. The mounting openings each include a first opening portion, a second opening portion, and a third opening portion extending from the first opening portion to the second opening portion. The first, second, and third opening portions collectively define a generally dog bone shape.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
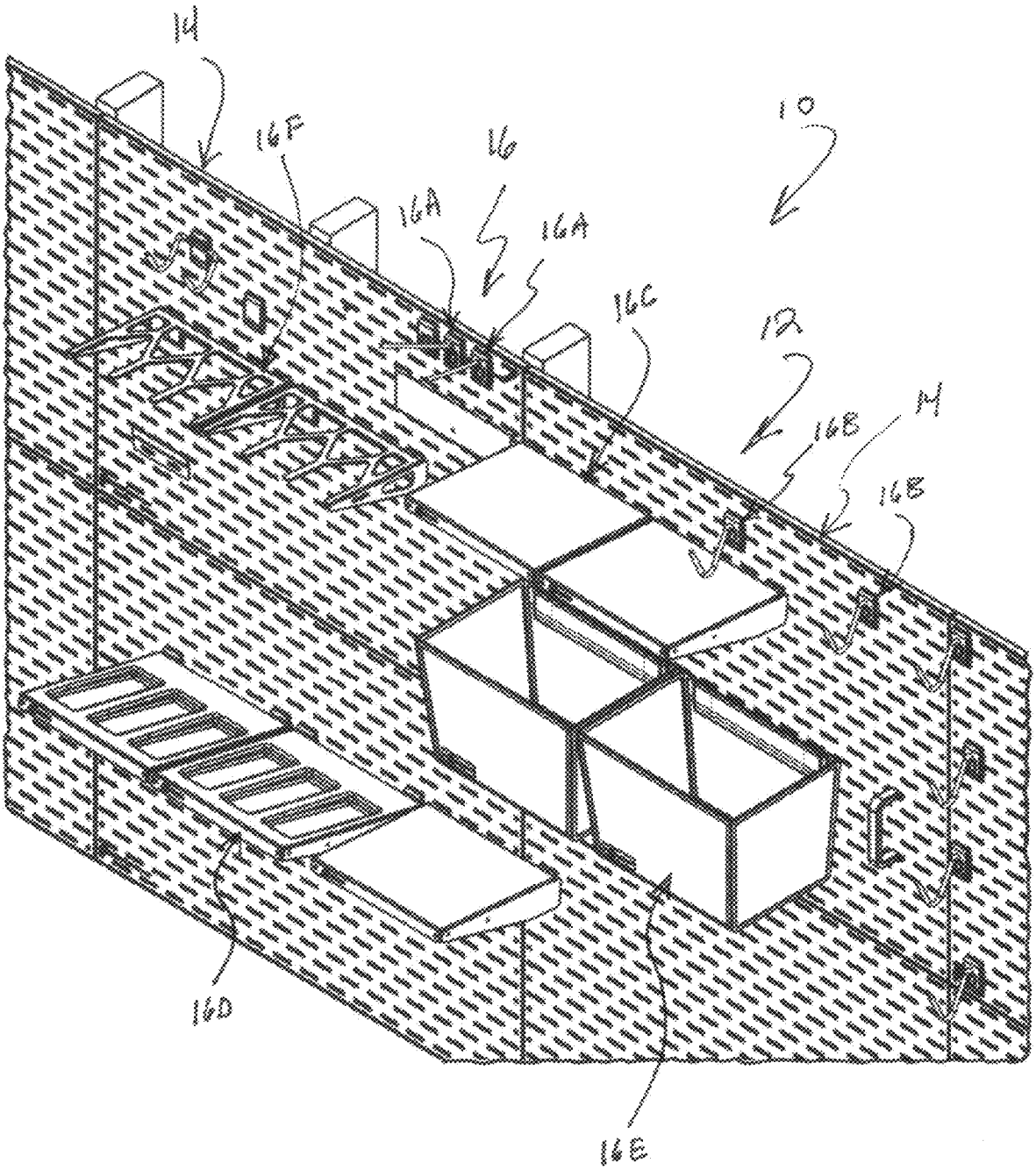
FIG. 1 is a fragmentary perspective of a mounting panel system of the present disclosure.

Referring to FIG. 1, a panel mounting system of the present disclosure is designated generally by 10. The panel mounting system can be used for holding tools, supplies, firearms, firearm accessories, or other objects. In the illustrated embodiment, the panel mounting system 10 includes a panel system 12 comprising a plurality of panels 14 and a variety of panel accessories 16 mountable on the panel system. For example, the panel accessories can include a variety of hangers 16A, hooks 16B, shelves 16C, 16D, storage containers 16E, firearm supports 16F, etc. The panel system 12 can be mounted above a work bench, in a firearm vault, on a garage wall, etc. It will be appreciated other configurations of panel mounting systems can be used without departing from the present disclosure. Moreover, it will be appreciated that aspects of the panel mounting system and components thereof can be incorporated in other types of systems or components without departing from the scope of the present disclosure.

Figure 2:
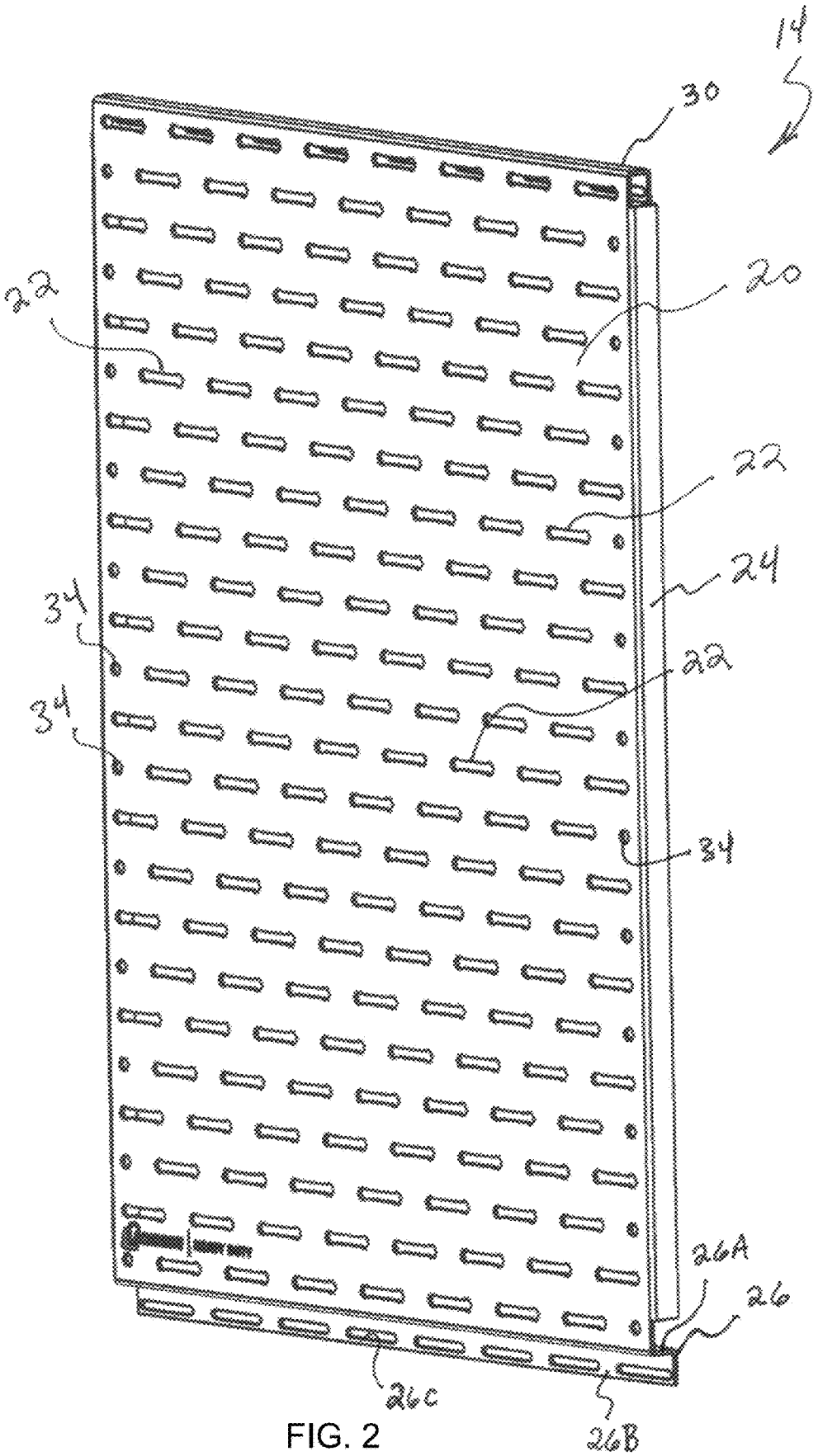
FIG. 2 is a front perspective of a panel of the mounting panel system.
Figure 3:
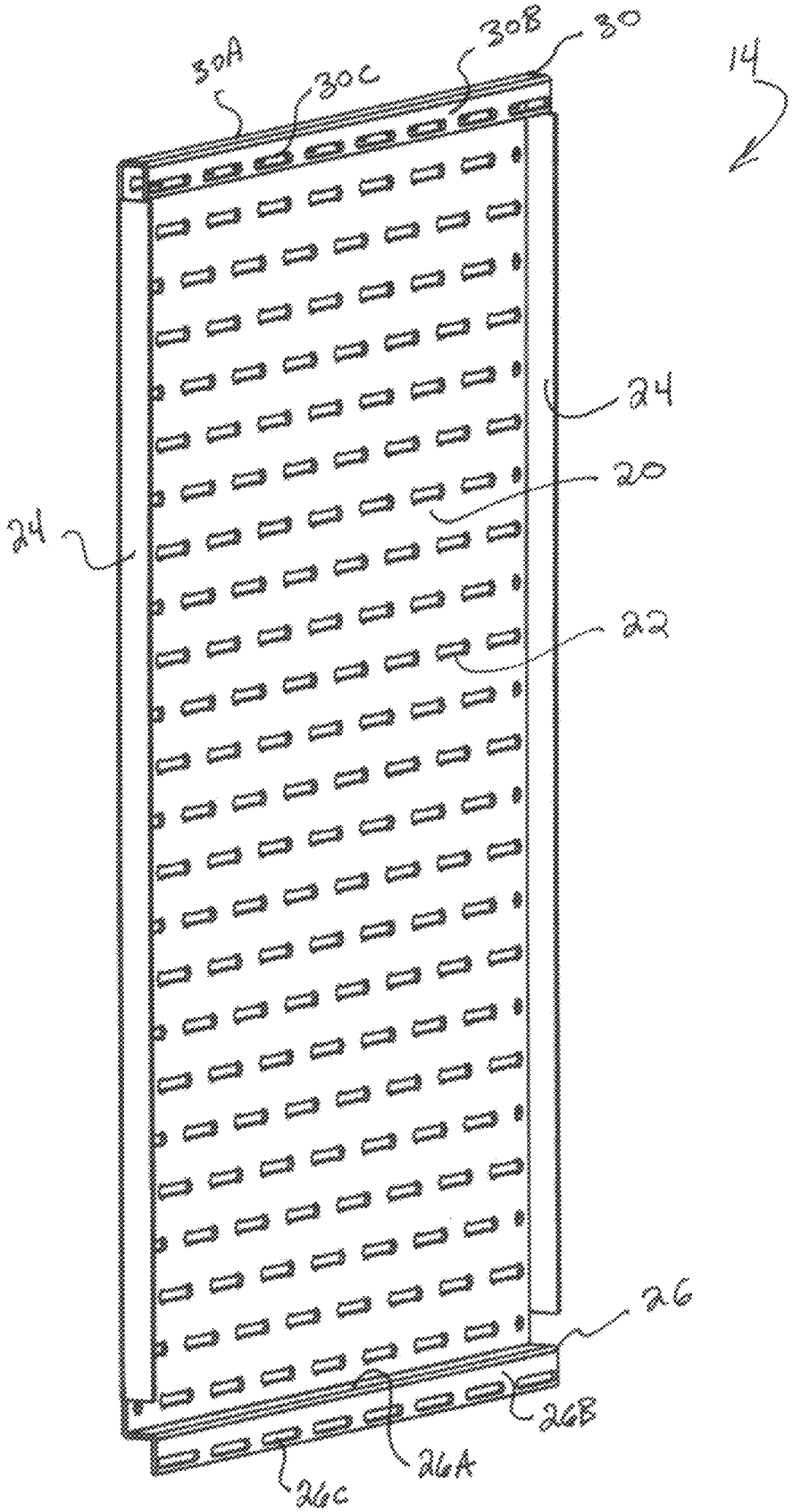
FIG. 3 is a rear perspective of the panel of FIG. 2.

Referring to FIGS. 2 and 3, a panel 14 of the panel system 12 is shown by itself. The panel 14 will be described in detail with the understanding other panels of the system have similar configurations but may vary in width and/or height. Referring to FIG. 2, the panel 14 has a height extending between upper and lower ends of the panel and a width extending between left and right sides of the panel. The panel 14 includes a panel body comprising a web 20 having a mounting surface facing out of the page in FIG. 2. The web 20 includes a plurality of mounting openings 22 configured to receive panel accessories 16 for mounting the panel accessories on the panel. At left and right sides of the web 20, the panel includes braces 24 formed by flanges extending rearward from the web. At a lower end of the web 20, the panel includes a connector 26 comprising a first flange portion 26A extending rearward from the web and a second flange portion or lip 26B extending downward from the first flange portion. The lip includes a plurality of slots 26C sized and shaped to receive a fastener (e.g., screw) for securing the panel to support structure (e.g., a wall, framing, wood studs, etc.). At an upper end of the web 20, the panel includes a collar 30 comprising a first flange portion 30A extending rearward from the web and a second flange portion or tongue 30B extending downward from the first flange portion. The tongue includes a plurality of slots 30C sized and shaped to receive a fastener for securing the panel to support structure.

In the illustrated embodiment, the mounting openings 22 are arranged in an array extending along the width and height of the web 20. The mounting openings 22 are shown as being generally elongate, extending horizontally, and having a "dog bone" shape, but other shapes and arrangements can be used without departing from the scope of the present disclosure.

Figure 6:
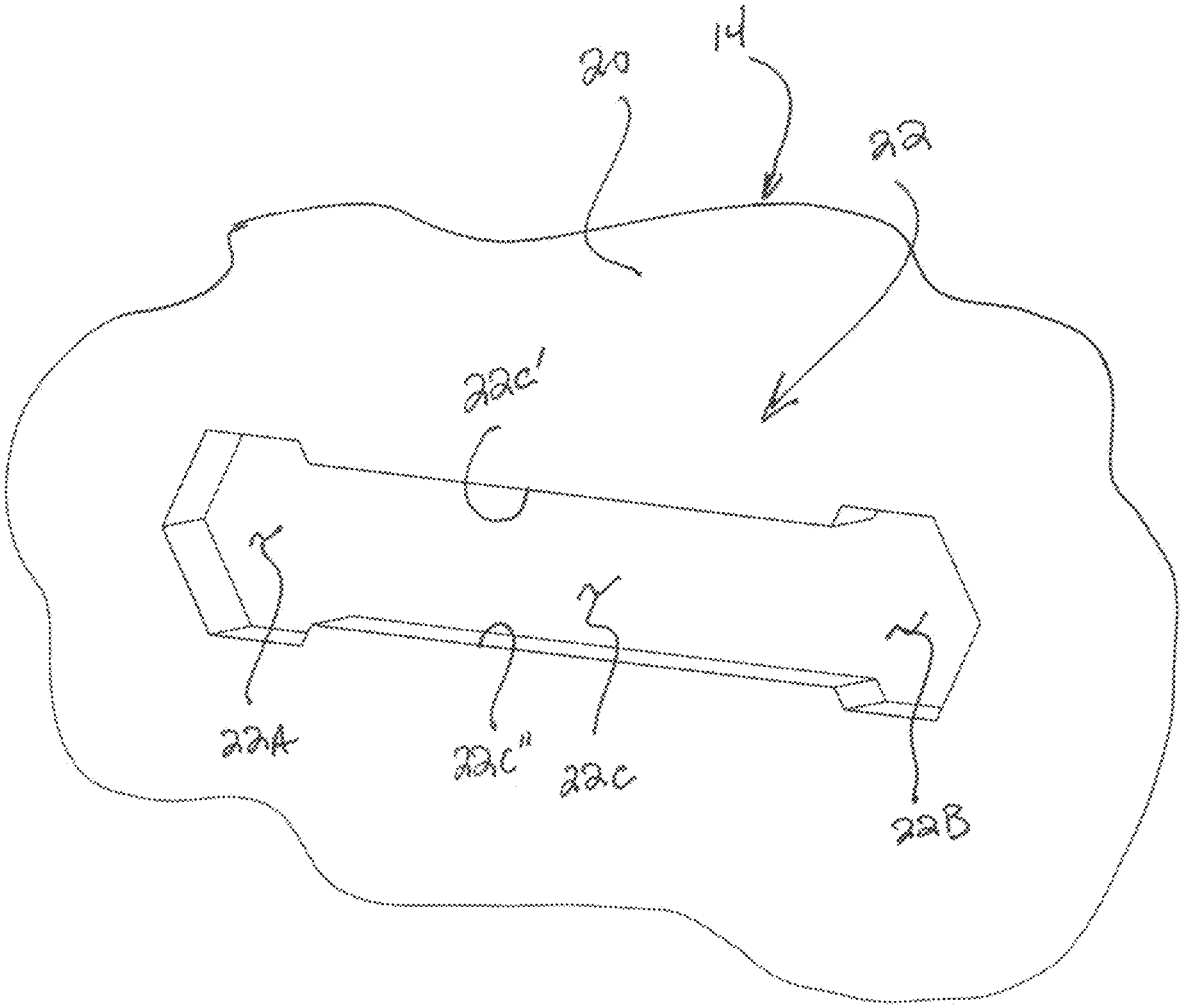
FIG. 6 is an enlarged fragmentary perspective of a panel showing a mounting opening of the panel.

Referring to FIG. 6, each mounting opening 22 includes a left (first) opening portion 22A (e.g., hole), a right (second) opening portion 22B (e.g., hole), and a third opening portion 22C in the form of an elongate slot connecting the left and right end opening portions. In the illustrated embodiment, the left and right opening portions 22A, 22B have hexagonal shapes, which provide an aesthetically pleasing appearance. However other polygons (broadly, shapes) e.g. circle, square, pentagon, octagon, etc. can be used without departing from the scope of the present disclosure. The left and right opening portions 22A, 22B are dimensioned to receive pegs of conventional peg board panel accessories. For example, the left and right opening portions 22A, 22B can be spaced about 1 inch on center from each other and can be about 0.25 inch (about 6.35 mm) tall by about 0.25 inch wide.

The elongate slot 22C includes an upper (first) edge 22C' and an opposing lower (second) edge 22C" spaced from each other by about 5 mm, which is less than the height of the left and right opening portions (about 0.25 inch or 6.35 mm). The slot 22C is configured to receive panel accessory mounts of the present disclosure, as explained in further detail below. The shorter height of the slot 22C relative to the heights of the left and right opening portions 22A, 22B gives the mounting opening its "dog bone" shape. The slot 22C is longer than the end opening portions 22A, 22B are wide. The narrowing of the dog bone shape from the left and right opening portions 22A, 22B to the slot 22C is useful to locate pegs of conventional peg board panel accessories in the left and right opening portions and prevent migration of the pegs into the slot. Other arrangements can be used without departing from the scope of the present disclosure.

The mounting openings 22 are arranged in rows, and the mounting openings of a row extend in line with each other. Mounting openings 22 in one row are offset with respect to mounting openings in rows immediately above and below that row. End portions 22A, 22B of a mounting opening 22 are in vertical registration with end portions 22A, 22B of immediately adjacent mounting openings 22 above and below that mounting opening. Adjacent the left and right sides of the web 20, a second type of mounting opening 34, not having the "dog bone" shape, is provided in some rows. The end portions 22A, 22B of the dog-bone shaped mounting openings 22 are desirably spaced about 1 inch on center from the end portions 22A, 22B of adjacent dog-bone shaped openings such that the end portions 22A, 22B of the dog-bone shaped mounting openings form a grid of non-offset opening portions arranged in columns and rows with one inch on center spacing both vertically and horizontally. Other configurations can be used without departing from the scope of the present disclosure.

Figure 4:
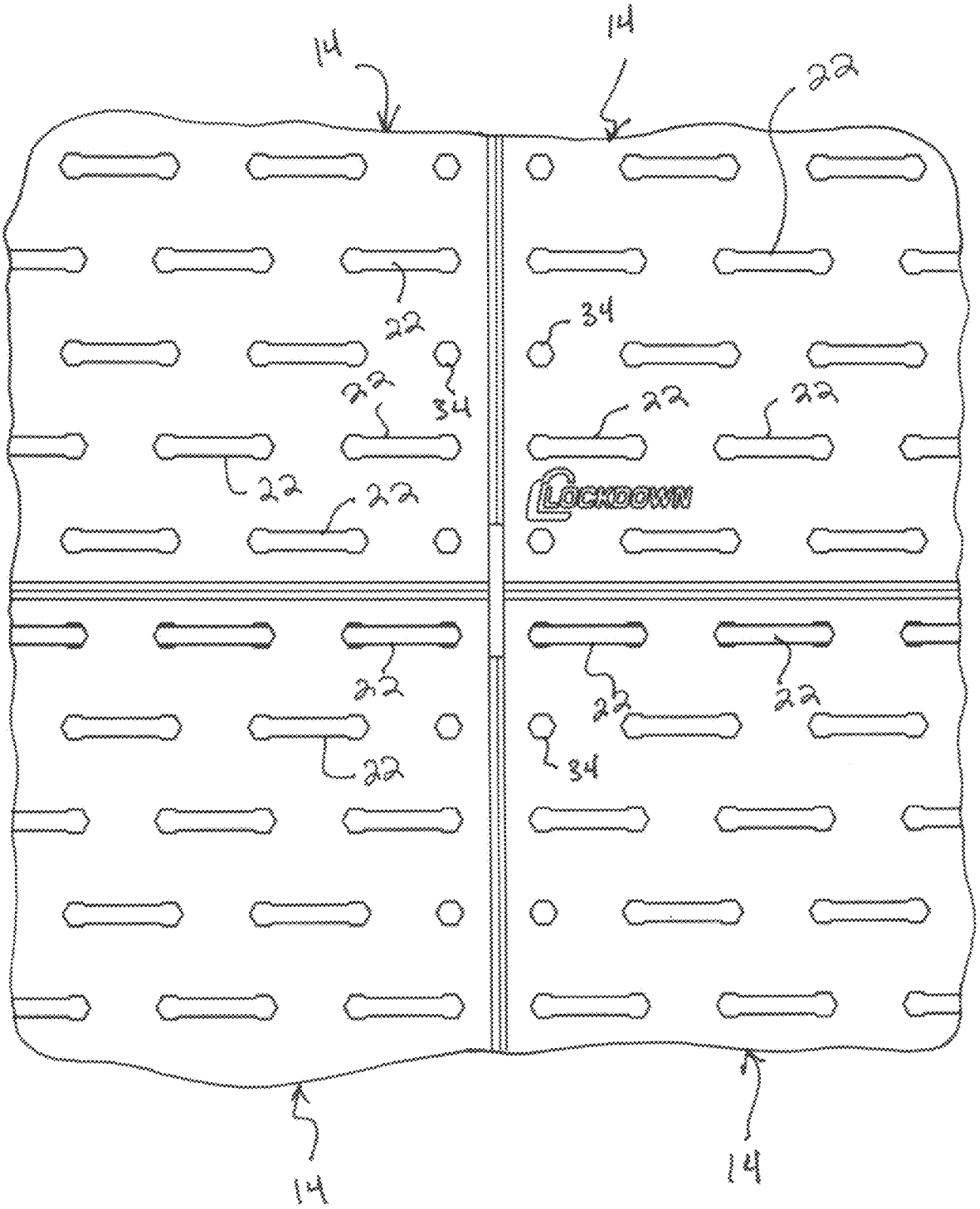
FIG. 4 is an enlarged fragmentary front view of corners of four panels arranged with respect to each other to form a panel system.
Figure 5:
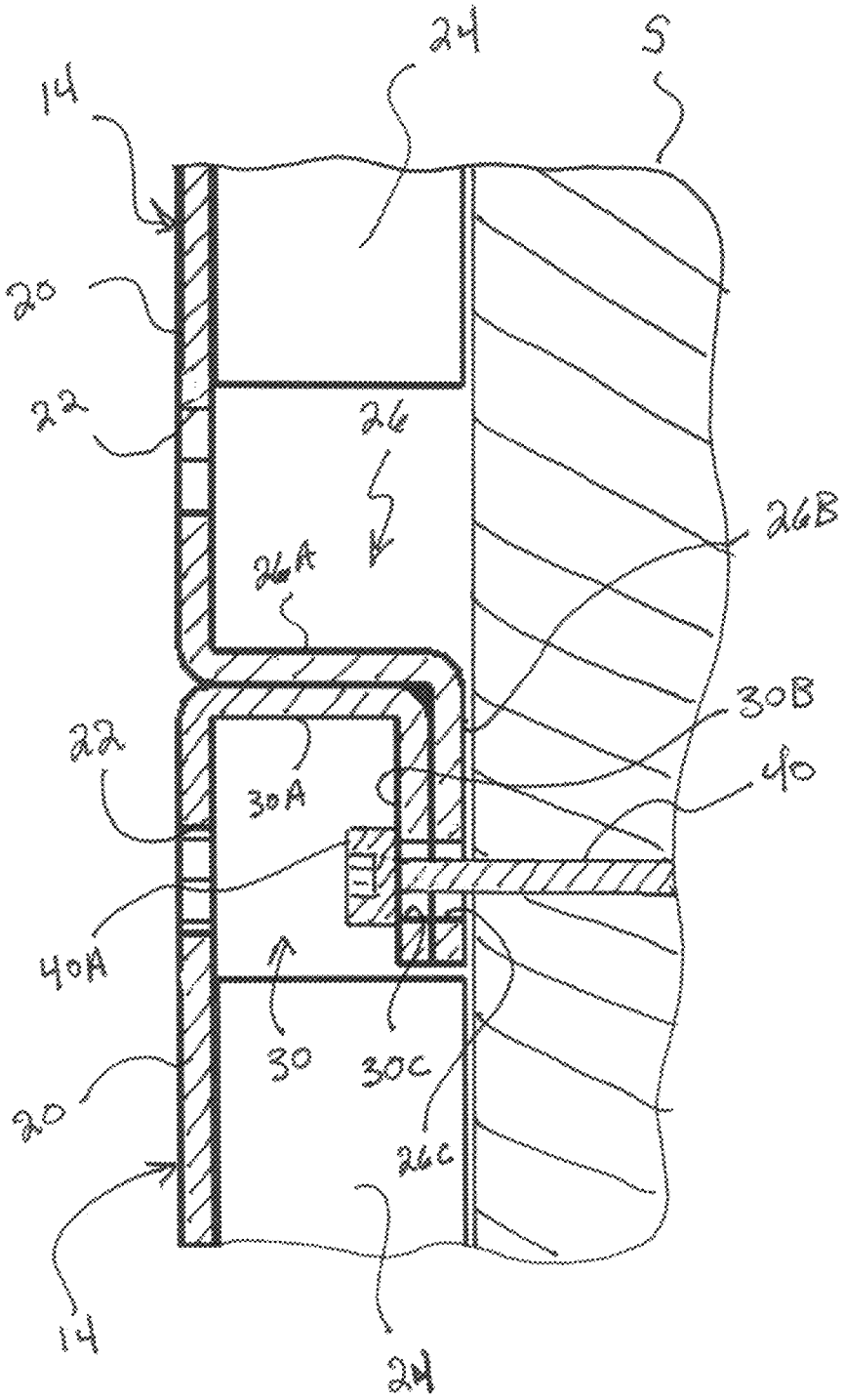
FIG. 5 is a fragmentary cross-section of two panels and a fastener securing the panels to support structure.

As shown in FIGS. 1 and 4, panels 14 may be arranged next to each other to form a panel system 12 in which panels are located side-by-side with each other, and rows of panels are located above each other. As shown in FIG. 5, when one panel 14 is located above another panel 14, the collar 30 of the lower panel can nest with the connector 26 of the upper panel. When the panels 14 are nested, the tongue 30B of the collar is in flatwise engagement with the lip 26B of the connector, and the first flange portions 26A, 30A are in flatwise engagement. Desirably, the slots 26C, 30C of the lip 26B and tongue 30B are configured such that they at least partially overlap to permit passage of a fastener 40 (e.g., screw) therethrough to secure the two panels to support structure S. A head 40A of the fastener is sized to abut the face of the tongue 30B of the collar and is sufficiently small to pass through an opening (such as a mounting opening 22) in the panel web 20 to permit installation of the fastener. The fastener 40 can be fed through an opening in the web 20, which permits the head of the fastener to be concealed behind the web. It will be appreciated that the nesting of the collar 30 and connector 26 is configured such that the front accessory mounting surfaces of the webs 20 of the two panels 14 are in plane with each other. The collar 30 is arranged to be spaced from the support structure S to permit the lip 26B to be located between the collar and the support structure.

With reference to FIG. 4, it will be appreciated that when the panels 14 are arranged side-by-side (e.g., when the braces 24 of adjacent panels abut), and when the panels are arranged one above another (e.g., when the collar 30 and connector 26 are nested), the rows of mounting openings 22 of the panels are in registration with each other to form a generally continuous array of mounting openings. The rows of mounting openings 22 generally continue from one panel 14 to another across a seam or joint between the panels. The one-inch on center pattern with respect to the end opening portions 22A, 22B of the dog-bone shaped mounting openings 22 continues from one panel to the next across the seam or joint. In some instances, the second type of mounting openings 34 are provided adjacent the left or right side of the panel. The generally continuous pattern of mounting openings 22 across the panel system allows a user flexibility in mounting panel accessories 16 where desired. The seams or joints between panels present minimal obstruction to permitting a user to mount accessories as desired on the panel system. Other arrangements can be used without departing from the scope of the present disclosure.

The panels 14 can be formed of sheet metal or another suitable material. For example, in manufacture, the mounting openings 22 can be formed in the sheet metal (e.g., cut, punched, etc.), and the edge margins of the sheet metal can be formed into the side braces 24, collar 30, and connector 26 by bending the sheet metal. Other constructions can be used without departing from the scope of the present disclosure.

Figure 7:
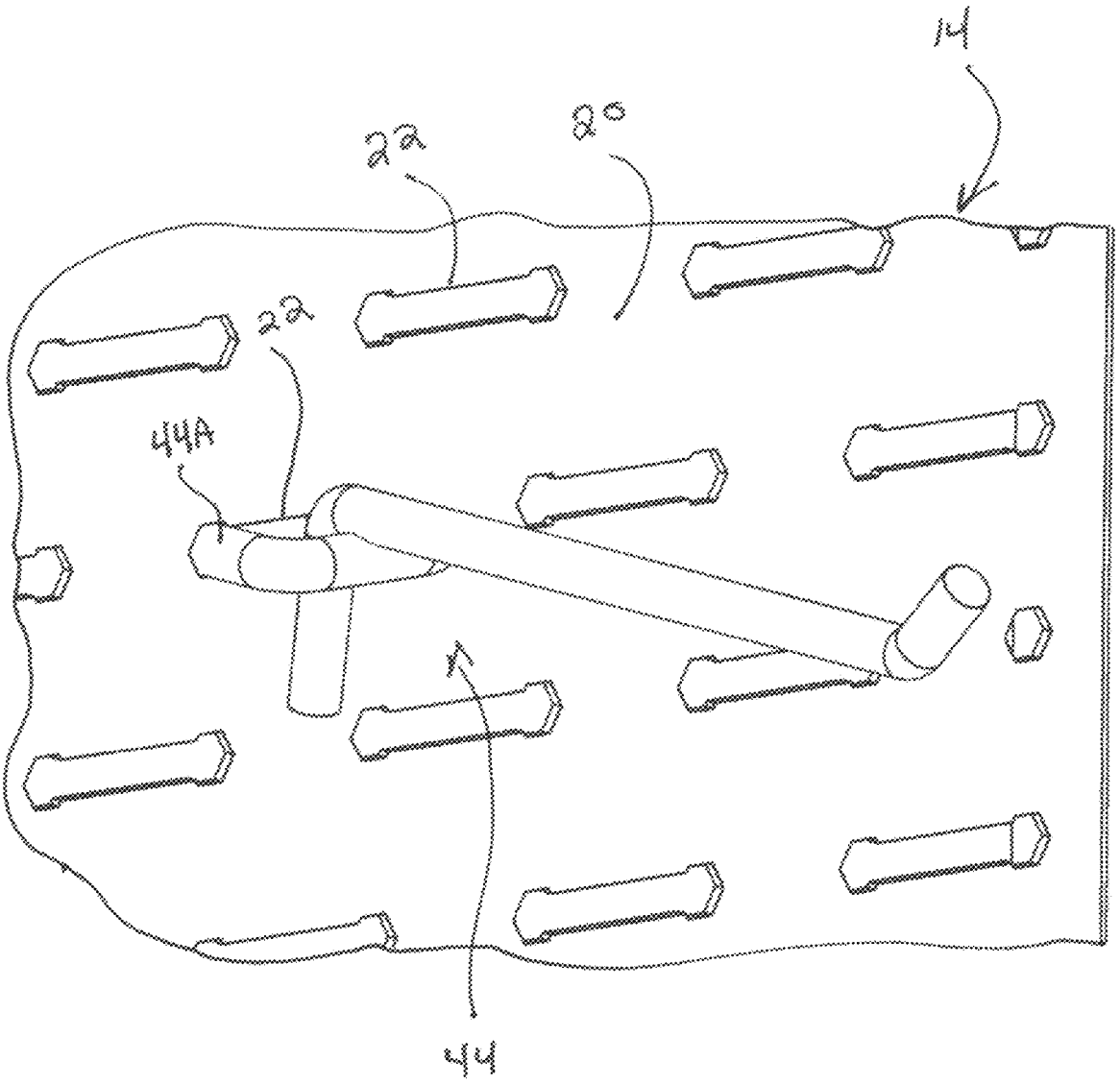
FIG. 7 is a fragmentary perspective of a panel with a conventional panel accessory mounted thereon.
Figure 8:
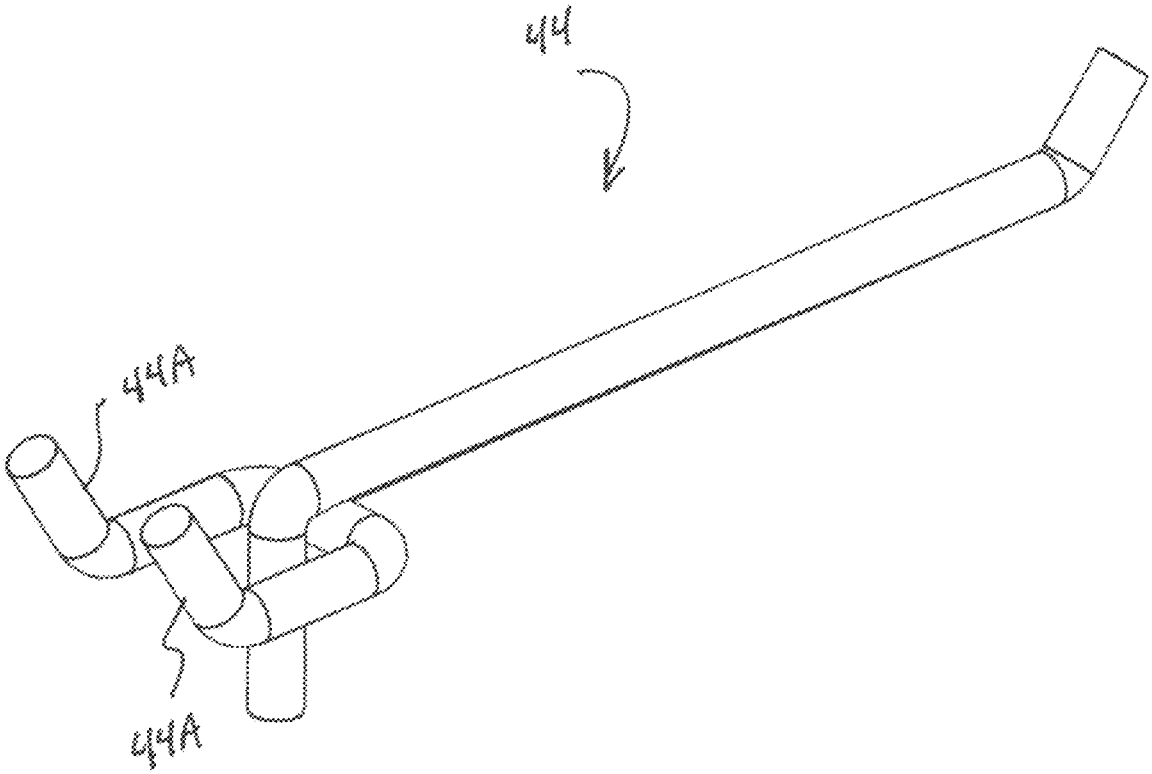
FIG. 8 is a rear perspective of the conventional panel accessory of FIG. 7.
Figure 9:
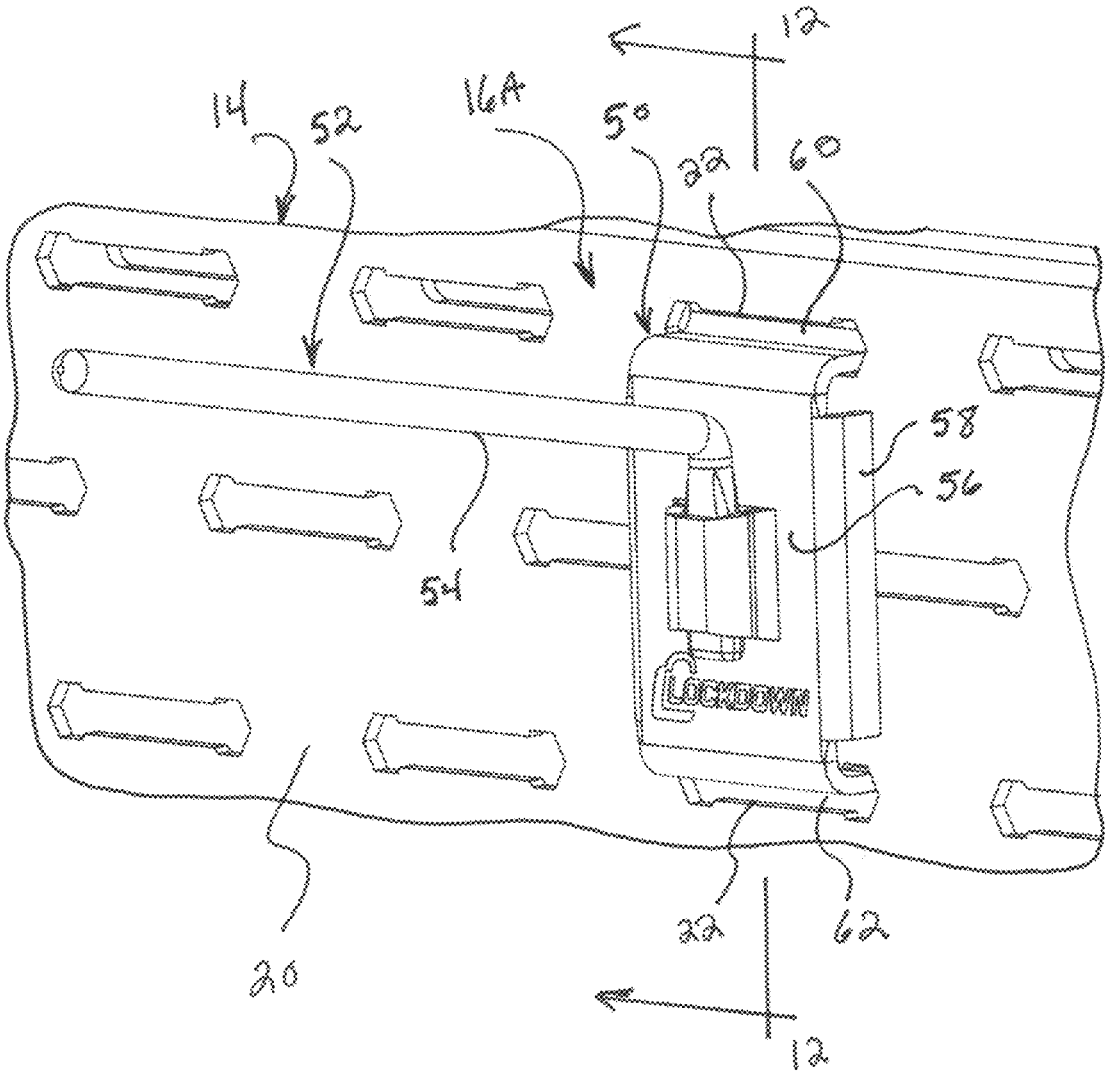
FIG. 9 is a fragmentary perspective of a panel with a panel accessory of the present disclosure mounted thereon.
Figure 10:
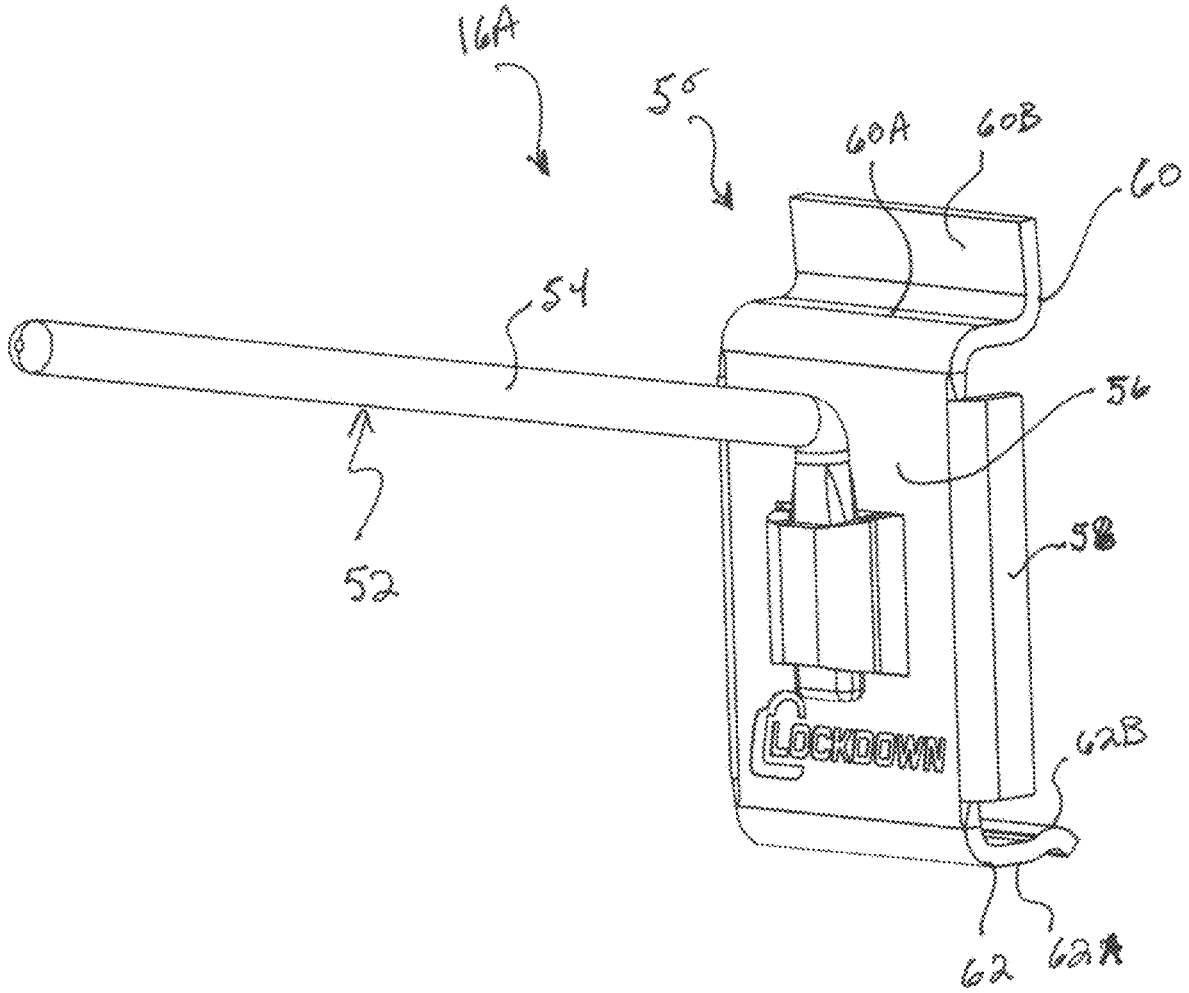
FIG. 10 is a front perspective of the panel accessory of FIG. 9.
Figure 11:
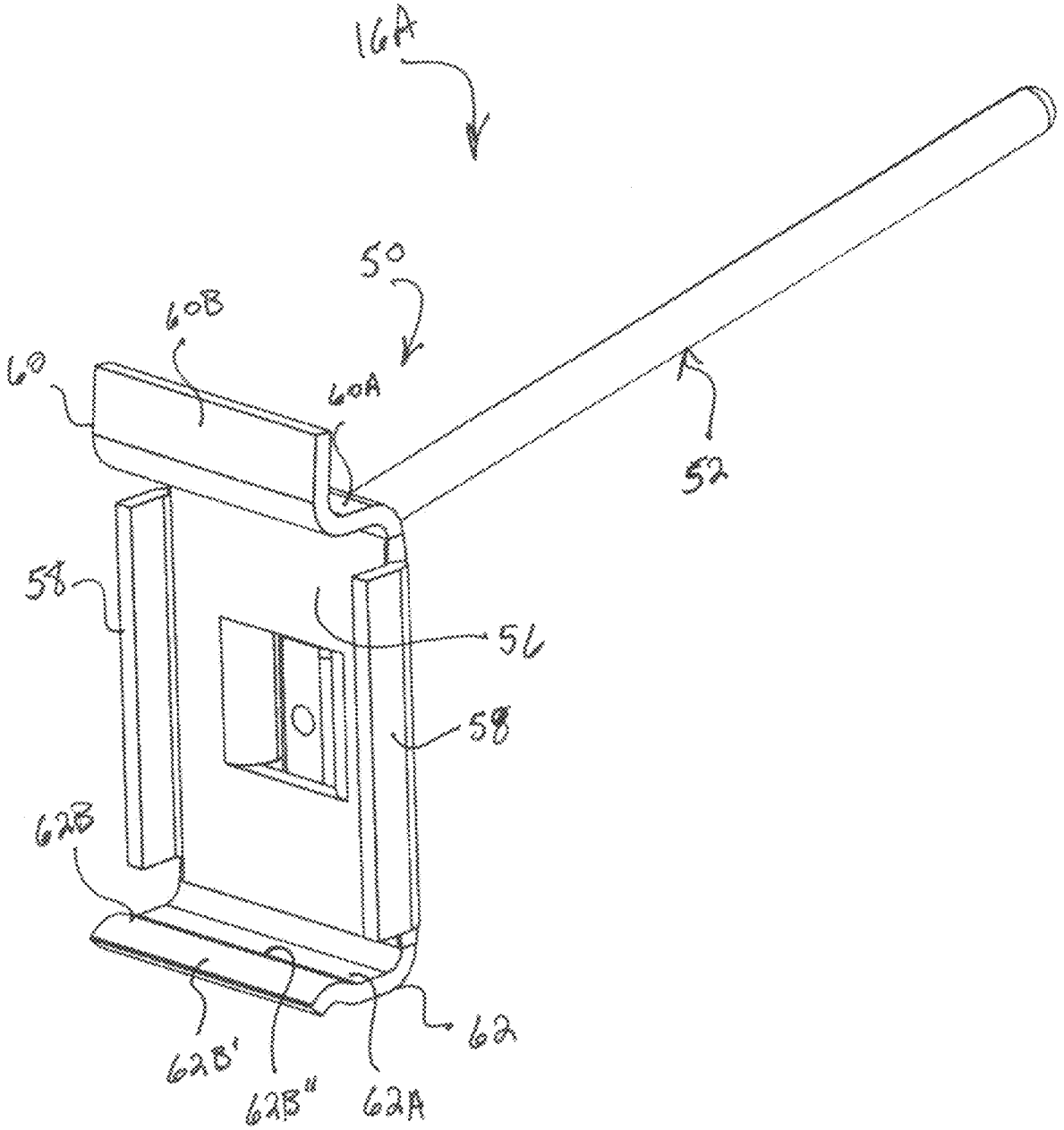
FIG. 11 is a rear perspective of the panel accessory.
Figure 12:
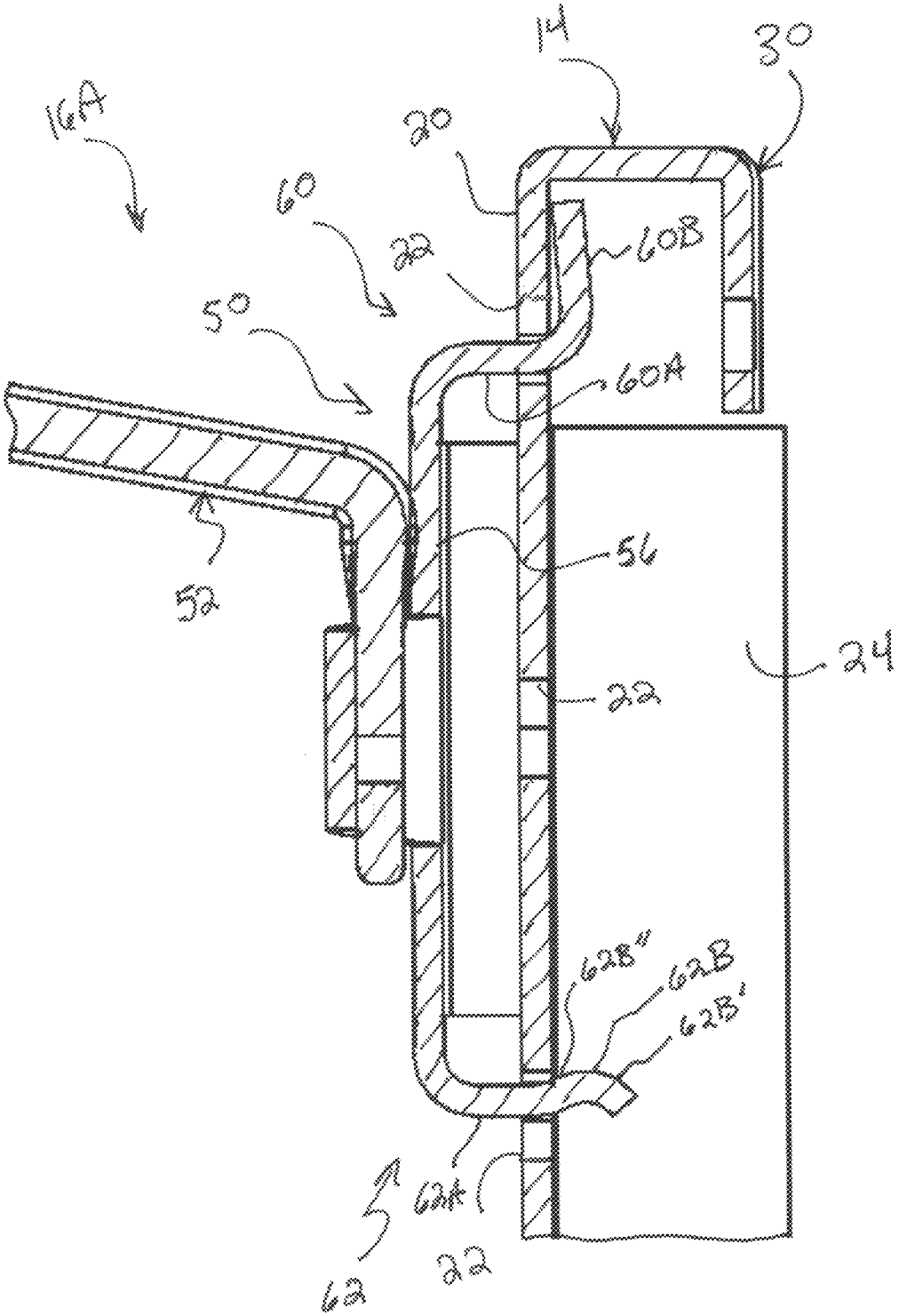
FIG. 12 is a fragmentary section through the panel and panel accessory taken in a plane indicated at 12-12 in FIG. 9.

The mounting openings 22 are configured to permit a variety of panel accessories to be mounted thereon. For example, the mounting openings 22 permit the panel system to receive conventional peg board accessories having 0.25 inch mounting pegs by receipt of the pegs in the left and right opening portions 22A, 22B at ends of the dog bone shapes. Referring to FIGS. 7 and 8, a conventional peg board hanger 44 can be mounted on a panel 14 by receiving rear pegs 44A of the hanger in opening portions 22A, 22B. The opening portions 22A, 22B can be part of the same mounting opening 22 (e.g., opposite ends of the dog bone shape) or parts of adjacent mounting openings (adjacent ends of two dog bone shapes). Other types of conventional peg board accessories can be used as well, if desired. However, it will be appreciated that conventional peg board accessories may rattle or tend to move when removing an item therefrom, as is the case when conventional peg board accessories are mounted on conventional peg boards.

Referring to FIGS. 9-12, a novel panel accessory of the present disclosure will be described in more detail. This panel accessory may be referred to as a hanger 16A for hanging an object on the panel system 12. For example, the hanger 16A can be made of steel or another suitable material. The hanger 16A includes a panel mount 50 and an object support 52 configured to be supported by the panel mount and thus the panel system 12 when the panel mount is mounted on the panel system. In one example, the panel mount 50 is formed from a piece of sheet metal (formed by bending/cutting/punching) such that the components of the panel mount are integrally formed with each other. The object support 52 comprises an arm 54 having a proximal end connected to the panel mount 50 and a distal free end. The panel mount 50 includes a main body 56 defining an object support connector, opposing side walls 58 (braces) extending rearward from the object support connector, an upper (first) portion 60 extending rearward from the object support connector, and a lower (second) portion 62 extending rearward from the object support connector.

The upper (first) portion 60 forms a first panel connector comprising a flange including a first arm 60A extending generally rearward from the main body 56 and a second arm 60B extending upward at an angle from the first arm to a free end of the flange. The flange 60 is connected to the main body 56 by a shoulder, and the first and second arms 60A, 60B are connected at an elbow of the flange. The second arm 60B extends upward and slightly forward with respect to the main body 56 to promote engagement of the fee end of the second arm with a rear side of a panel 14 on which the accessory is mounted. The first and second arms 60A, 60B may be referred to broadly as forming a hook. The free end of the hook (the distal end of the flange or, broadly, "rear panel engagement surface") engages the rear side of the panel at a location spaced upward from the mounting opening 22 through which the flange extends.

The lower (second) portion 62 forms a second panel connector comprising a flange including a lower arm 62A extending generally rearward from the main body. The flange is connected to the main body 56 by a shoulder. A distal end portion of the arm 62A includes a curved segment 62B protruding upward and having a distal cam surface 62B' and a proximal cam surface 62B" for reasons explained below. The upwardly protruding portion 62B can be referred to as a detent or lug.

The side walls 58 extend rearward from the sides of the main body 56 and have panel engagement free edges (engagement surfaces) located to brace the mount 50 against the front mounting surface of a panel 14 when the upper and lower connectors 60, 62 are received in respective mounting openings 22 of the panel. The panel mount 50 is sized and shaped so that the upper and lower connectors 60, 62 are located to be received in respective mounting openings 22 in vertical registration with each other. For example, the upper and lower connectors 60, 62 can be about two inches from each other.

To mount the panel accessory 16A on a panel 14, a user inserts the upper or first panel connector 60 into a first mounting opening 22. The user then generally pivots the panel mount 50 downward (e.g., using the object support 52 as a lever) to bring the lower or second panel connector 62 into registration with a second mounting opening 22. The free end of the lower panel connector 62 enters the second mounting opening 22 and the distal cam surface 623 engages the upper edge of the slot 22C of the mounting opening. As the user applies sufficient force to continue pivoting the panel mount 50 downward, the distal cam surface 62B' cams on the upper edge of the slot 22C such that the arm of the lower panel connector 62 resiliently deflects downward to permit passage of the detent/lug 62B into the slot 22C. After the detent/lug 62B passes sufficiently through the slot 22C, the side braces 58 pivot into generally flatwise engagement with the front surface of the panel 14, and the arm of the lower connector 62 resiliently moves upward toward its at-rest configuration. The lower connector 62 may provide audible and/or tactile feedback to the user of snapping into position. The proximal cam surface 62W' of the detent/lug 62B comes to rest against a rear upper edge of the mounting opening 22. Desirably, in this configuration, the arm of the lower connector 62 is still slightly deflected from its at-rest configuration such that the arm resiliently applies a cam force via the proximal cam surface 62B". This force causes the free end of the upper connector 60, the free ends of the braces 58, and the proximal cam surface 62B" of the lower connector 62 to remain in engagement with the panel 14 and desirably forms a stable and rattle-free, secure mounting connection.

To remove the accessory 16A from the panel 14, a user may use the object support 52 as a lever to push upwardly which will pry the lower connector 62 out of the lower mounting opening 22. The upward force on the object support 52 causes the proximal cam surface 62B" of the lower connector 62 to cam on the upper edge of the slot 22C and resiliently deflect the lower arm downward to permit passage of the detent/lug 62B out of the slot. The upper connector 60 can then be removed from the upper mounting opening 22.

It will be appreciated that the installation and removal of the panel accessory 16A (and other panel accessories 16) can be accomplished without tools yet provides a significantly improved mounting connection relative to conventional peg board configurations.

Figure 13:
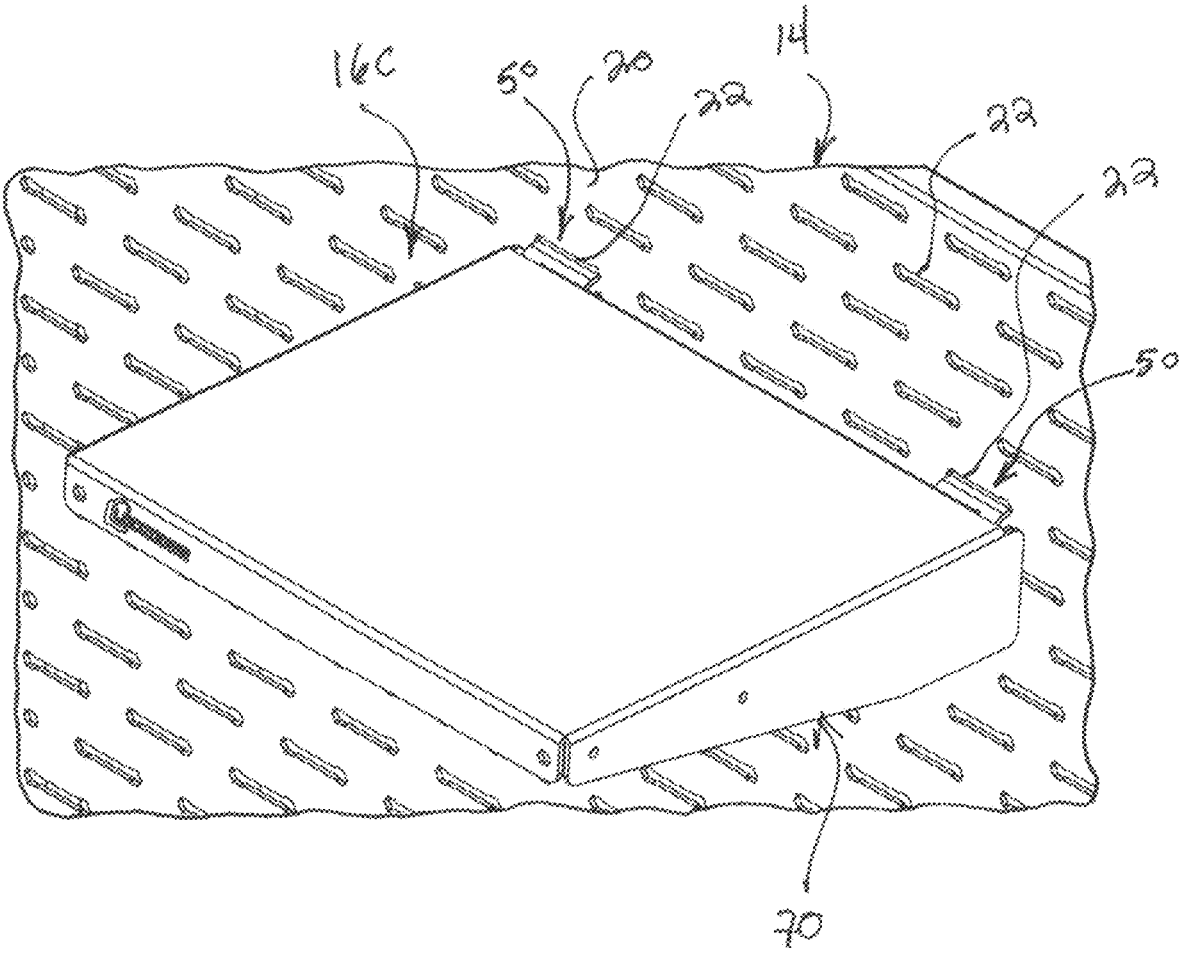
FIG. 13 is a fragmentary perspective of a panel and another panel accessory of the present disclosure.
Figure 14:
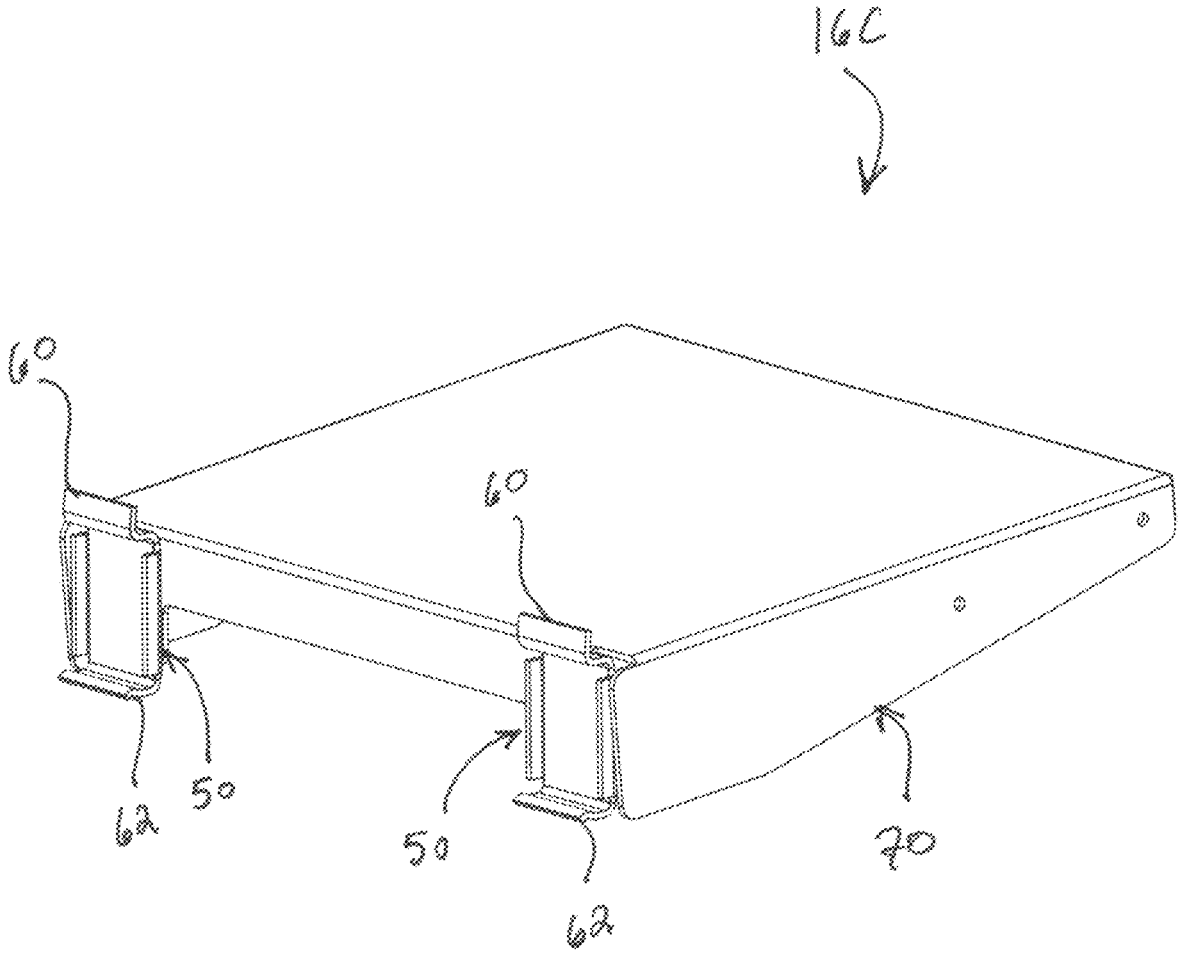
FIG. 14 is a rear perspective of the panel accessory of FIG. 13.

Referring to FIGS. 13 and 14, another novel panel accessory of the present disclosure is shown. This panel accessory may be referred to as a shelf 16C for supporting an object on the panel system 12. For example, the shelf 16C can be made of steel or another suitable material. The shelf 16C includes two panel mounts 50 (at least one panel mount) and an object support in the form of a shelf body 70 including a horizontal panel having an upwardly facing surface for underling an object to be supported thereon. The panel mounts 50 have an identical configuration to the panel mount 50 described above except the main body 56 is connected to the shelf body 70 instead of a hanger arm. To install the shelf 16C on the panel 14, a user manipulates the shelf to locate the upper connectors 60 of the two panel mounts 50 in mounting openings 22 of a common row, and then the user pivots the shelf body downward to engage and snap the lower connectors 62 into securing engagement in respective lower mounting openings 22. The camming action and secure mounting of the panel mounts 50 happens in the same way as described above but in tandem with respect to the two mounts. To remove the shelf 16C from the panel 14, the user pushes upward on the free end of the shelf body 70 to cause the lower connectors 62 to dislodge from the lower mounting openings, and the upper connectors 60 are then removed from the upper mounting openings.

It will be appreciated that the other panel accessories 16 shown in FIG. 1 are similar to the panel accessories 16A, 16C described with respect to FIGS. 9-14 in that they include one or more panel mounts 50 and an object support of some type (e.g., hook, container, firearm support, etc.).

Figure 15:
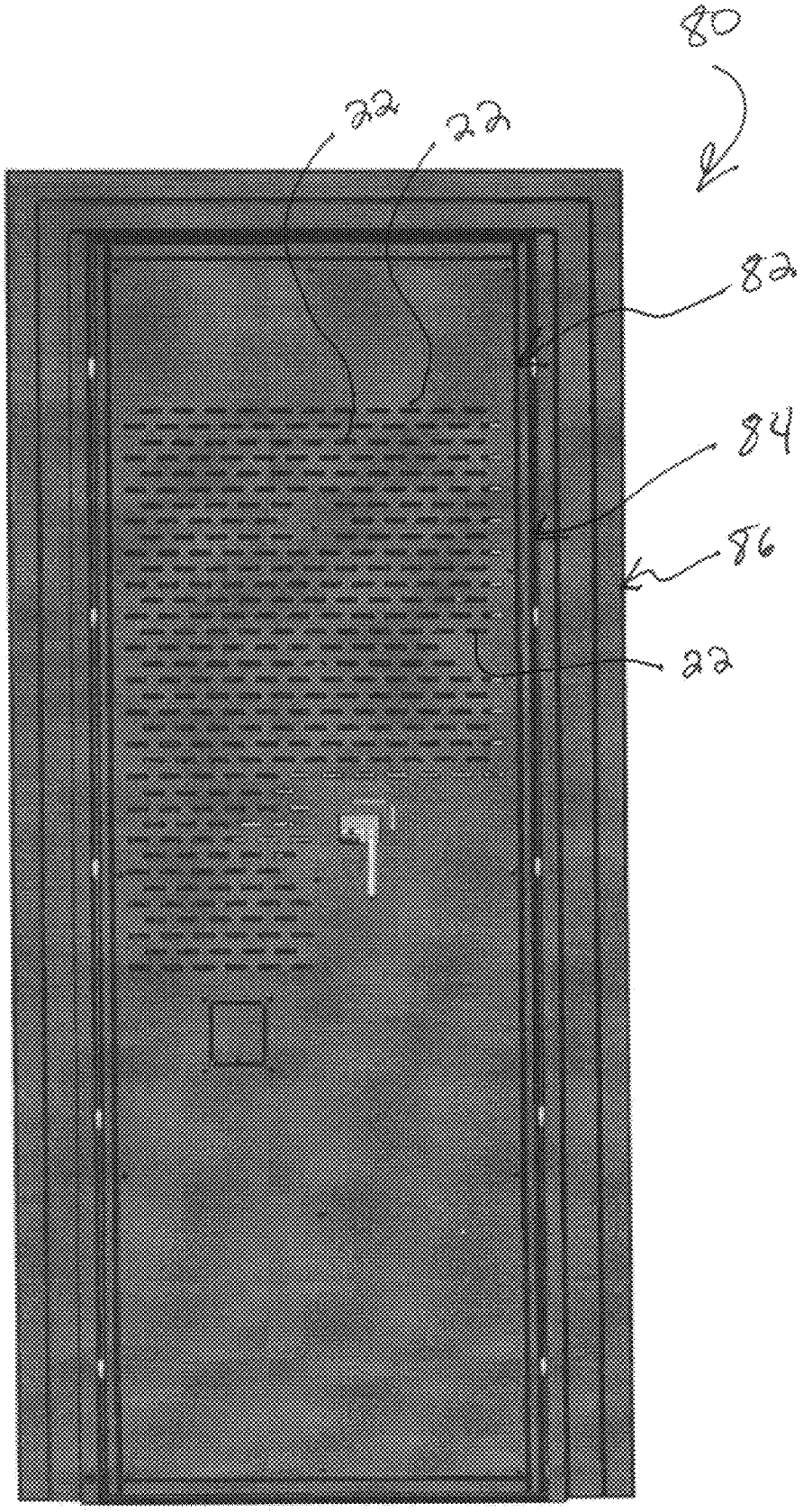
FIG. 15 is a rear view of a vault wall of the present disclosure, the vault wall including a panel system for receiving panel accessories of the present disclosure.

Referring to FIG. 15, a vault 80 (e.g., firearm vault) may be configured to include a panel 82 similar to the panels 14 described above for mounting one or more panel accessories 16. The vault 80 may be a room of a home (e.g., basement room) or may comprise a container such as a metal housing. FIG. 15 shows a rear side of a door 84 of such a vault 80 in a door frame 86 (broadly, housing portion), and the rear side of the door comprises the panel 82 including an array of mounting openings 22 as described above. It will be appreciated other walls of such a vault 80 (e.g., non-door walls) can have similar panels with arrays of mounting openings 22. The user can mount panel accessories 16 in the vault 80 on the panels as desired. Such panel accessories 16 can be used to support firearms, firearm components, firearm accessories, and/or ammunition on the panels.

It will be apparent that modifications and variations are possible without departing from the scope of the appended claims.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. A panel accessory for mounting on a panel having at least first and second mounting openings, the panel accessory comprising:

a panel mount comprising an object support connector, a first panel connector, and a second panel connector, the first panel connector extending rearward with respect to the object support connector for receipt in the first mounting opening of the panel, the second panel connector extending rearward with respect to the object support connector for receipt in the second mounting opening of the panel to mount the panel mount on the panel, the second panel connector comprising a first cam surface configured to cam against an upper edge of the second mounting opening as the second panel connector is inserted into the second mounting opening to resiliently deform the second panel connector to permit passage of the second panel connector in the second mounting opening for mounting the panel mount on the panel; and an object support connected to the object support connector, the panel mount configured to support the object support when the panel mount is mounted on the panel.

2. The panel accessory as set forth in claim 1, wherein the object support comprises a hanger.

3. The panel accessory as set forth in claim 1, wherein the object support comprises a shelf body.

4. The panel accessory as set forth in claim 1, wherein the object support comprises a container.

5. The panel accessory of claim 1, wherein the panel mount is an integrally formed one-piece component.

6. The panel accessory of claim 5, wherein the panel mount is made of sheet metal.

7. The panel accessory of claim 1, wherein the first panel connector includes an arm configured to engage a rear surface of the panel when the panel mount is mounted on the panel, the arm extending at a skew angle relative to the vertical.

8. The panel accessory of claim 1, wherein the second panel connector includes a curved segment protruding upward that forms the first cam surface.

9. The panel accessory of claim 1, wherein the first cam surface faces generally upward when the panel mount is mounted on the panel.

10. The panel accessory of claim 1, in combination with the panel, the first panel connector extending through the first mounting opening and the second panel connector extending through the second mounting opening when the panel mount is mounted on the panel.

11. A panel accessory mount configured to mount to a panel having a front surface, a rear surface, and at least one mounting opening, the panel accessory mount comprising:

a main body;

at least one brace extending rearward of the main body and including a rear surface configured to engage a front surface of the panel when the accessory mount is mounted on the panel;

a first panel connector comprising a hook configured to engage the rear surface of the panel when the accessory mount is mounted on the panel; and a second panel connector comprising an arm, the arm being resiliently deflectable with respect to the hook to permit mounting of the panel mount on the panel.

12. The panel accessory mount of claim 11, wherein the at least one brace extends from the main body.

13. The panel accessory mount of claim 11, wherein the at least one brace includes two braces spaced apart from one another.

14. The panel accessory mount of claim 13, wherein one of the two braces is disposed on a left side of the main body and the other of the two braces is disposed on a right side of the main body.

15. The panel accessory mount of claim 11, wherein the rear surface of the at least one brace is elongate and arranged to extend generally vertically when the panel accessory mount is mounted on the panel.

16. The panel accessory mount of claim 11, wherein the at least one brace is laterally offset with respect to the first and second panel connectors.

17. The panel accessory mount of claim 11, wherein the first panel connector is connected to the main body at a top of the main body and the second panel connector is connected to the main body at a bottom of the main body.

18. The panel accessory mount of claim 11, wherein the panel accessory mount is an integrally formed one-piece component.

19. The panel accessory mount of claim 11, further comprising a single piece of sheet metal, the single piece of sheet metal forming the main body, the at least one brace, the first panel connector, and the second panel connector.

20. The panel for mounting panel accessories thereon, the panel comprising:

a web comprising a plurality of mounting openings for receiving the panel accessories, the mounting openings each including a first opening portion, a second opening portion, and a third opening portion extending from the first opening portion to the second opening portion, the first, second, and third opening portions collectively defining a generally dog bone shape.

21. The panel as set forth in claim 20, wherein the plurality of mounting openings are arranged in a plurality of rows with the dog bone shapes extending along the rows.

22. The panel as set forth in claim 21, wherein the mounting openings in a first row of the plurality of rows are offset with respect to the mounting openings in a second row of the plurality of rows, the first row being located with respect to the plurality of rows immediately above the second row.

23. The panel as set forth in claim 20, wherein the first and second opening portions are located about one inch on center from each other.

24. The panel of claim 20, wherein the first and second opening portions each have a polygon shape.

25. The panel of claim 20, wherein the first and second opening portions each have a hexagonal shape.

26. The panel of claim 20, wherein the first and second opening portions each have a circle shape, a square shape, a pentagon shape, or an octagon shape.

27. The panel of claim 20, wherein the third opening portion is bounded by an upper linear edge of the web and by a lower linear edge of the web, the upper and lower linear edges each extending from the first opening portion to the second opening portion.

28. The panel of claim 20, in combination with a panel accessory having a panel mount, the panel mount including first and second panel connectors, the first panel connector configured to be inserted into a first mounting opening of the plurality of mounting openings and the second panel connector configured to be inserted into a second mounting opening of the plurality of mounting openings.

29. The panel of claim 20, further comprising first and second braces extending rearward of the web, the first brace extending along a first side of the web and the second brace extending along a second side of the web.

30. The panel of claim 29, further comprising a collar connected to the web and a connector connected to the web, the collar configured to nest with a connector of a second panel when the panel and second panel are connected together, and the connector configured to nest with a collar of a third panel when the panel and the third panel are connected together.

* * * * *